US006398177B1

(12) United States Patent
Yeh

(10) Patent No.: US 6,398,177 B1
(45) Date of Patent: Jun. 4, 2002

(54) BRACKET STRUCTURE OF COMPUTER DESK

(75) Inventor: Morgen Yeh, Taipei Hsien (TW)

(73) Assignee: Jurapolly Industry Inc., Taipei Hsien (TW)

( * ) Notice: Subject to any disclaimer, the term of this patent is extended or adjusted under 35 U.S.C. 154(b) by 1 days.

(21) Appl. No.: 09/686,870

(22) Filed: Oct. 12, 2000

(51) Int. Cl.[7] ..... A47B 91/00

(52) U.S. Cl. ..... 248/346.01; 248/298.1; 248/918; 312/208.1; 312/334.8

(58) Field of Search ..... 248/298.1, 346.01, 248/918, 118, 118.1; 108/143, 50.01; 312/208.1, 223.3, 334.7, 334.8

(56) References Cited

U.S. PATENT DOCUMENTS 4,736,689 A * 4/1988 Stanko ..... 108/5
5,205,631 A * 4/1993 Wegman et al. ..... 312/348.3

FOREIGN PATENT DOCUMENTS

WO WO 97/31558 * 9/1997

* cited by examiner

*Primary Examiner*—Anita King
*Assistant Examiner*—Holley N. Sy
(74) *Attorney, Agent, or Firm*—Rosenberg, Klein & Lee

(57) ABSTRACT

A bracket structure of computer desk, including: a bracket body made of one single metal panel by integral punching and pressing, a central portion of the bracket body being defined as a support section for supporting an article such as a keyboard, a mouse, etc., a front edge of the support section of the bracket body being formed with an elevated section to form a wrist rest section for a user's wrist to bridge over the wrist rest section for operating the keyboard or the mouse, a stop wall upward projecting from the rear edge of the support section for stopping the keyboard, etc. placed on the support section from rearward sliding or dropping, two ends of the bracket body being formed with insertion plates and fixing plates which are respectively bent upward and downward; two side bars respectively locked two sides of the bracket body; and pair of slide rails respectively mounted on outer sides of the side bars for guiding and slidably mounting the bracket body in a computer desk.

2 Claims, 4 Drawing Sheets

BRACKET STRUCTURE OF COMPUTER DESK

BACKGROUND OF THE INVENTION

1. Field of the Invention

The present invention relates to an improved bracket structure of a computer desk in which the bracket body is made of a metal panel by integral punching and pressing. A central portion of the bracket body is defined as a plane support section. A front edge of the support section is formed with an elevated section as a wrist rest section. A stop wall upward projects from the rear edge of the support section.

2. Description of the Prior Art

A conventional computer desk is designed for a user to place thereon personal computer monitor, main frame, keyboard, mouse, etc. A bracket with slide rails is mounted under the face of the computer desk for placing the keyboard thereon. FIG. 1 shows the bracket which includes a plane board B on which the keyboard is placed. Two sides of the plane board B are equipped with slide rails S for slidably mounting the bracket on lower side of the computer desk. When the keyboard is placed on the plane board B and in use, a user's wrist is directly bridged over the board body B for keying. The wrist is positioned at a height lower than the keyboard so that such attitude fails to meet the human body configuration. As a result, after a long period of operation, the wrist is subject to tiredness and pain. In order to solve this problem, the user must additionally buy an elongated rest bar which is placed on the bracket for the wrist to rest thereon.

The conventional bracket has such a width that only the keyboard can be placed thereon. Therefore, the mouse must be placed on another place. Generally, the mouse is placed on the desk face higher than the keyboard. Under such circumstance, the user must frequently move his/her hand between the higher desk face and the lower keyboard. This leads to much inconvenience in operation.

In order to solve the above problems, the bracket with slide rails mounted on lower side of the computer desk is widened, permitting the mouse to be also placed on the bracket. In addition, the bracket is directly formed with a wrist rest section the wrist to rest thereon. Such widened bracket is made of plastic material by molding or made of metal board equipped with additional reinforcing frame. With respect to the former, the increased width of the bracket will lead to insufficient structural strength of the plastic molded bracket. As a result, it often takes place that the bracket fails to support the depressing force of the user and is downward bent and deformed. With respect to the latter, it is hard to form the wrist rest section on the bracket. In the case that the wrist rest section is formed on the bracket for supporting the wrist, it will be impossible to mount the slide rails S on two sides of the bracket.

SUMMARY OF THE INVENTION

It is therefore a primary object of the present invention to provide an improved bracket structure of computer desk, in which the bracket body is made of one single metal panel by integral punching and pressing. The bracket body has sufficient width for placing both keyboard and mouse on the bracket body. A front edge of the bracket body is formed with a wrist rest section for a user's wrist to bridge over the wrist rest section for operating the keyboard or the mouse. Therefore, it is no more necessary to add an independent wrist rest bar on the bracket. A stop wall is formed on the rear edge of the bracket body for preventing the keyboard and the mouse from sliding outward and dropping. The wrist rest section and the stop wall also serve to reinforce the bracket structure.

It is a further object of the present invention to provide the above bracket structure in which two ends of the bracket body are formed with fixing plates which are respectively bent upward and downward. Therefore, the thickness of the bracket body will not exceed the thickness of the wrist rest section and the slide rails can be locked on two sides of the bracket body without increasing the height of the slide rails.

It is still a further object of the present invention to provide the above bracket structure in which by means of two fixing plates and three insertion plates formed on each of two ends of the bracket body, the bracket body can be firmly connected with the side bars to form a rigid bracket structure.

According to the above objects, the bracket structure of computer desk of the present invention includes a bracket body, two side bars and a pair of slide rails. The bracket body is made of one single metal panel by integral punching and pressing. The bracket body includes: a first side; a second side opposite to the first side; a third side connecting with one end of each of the first and second sides; a fourth side connecting with the other end of each of the first and second sides; a rectangular support section defined by the first, second, third and fourth sides, the support section being a plane section for supporting an article such as a keyboard, a mouse, etc.; a stop wall upwardly projecting from the first side of the bracket body in a first direction normal to the support section, each of two ends of the stop wall having an outward extending first insertion plate; and a wrist rest section elevated from the second side of the bracket body in the first direction opposite to the stop wall, the wrist rest section serving as a section for a user's wrist to bridge over to operate the keyboard or the mouse, the wrist rest section having a rest portion upward projecting from the support section, a first edge bent and connected between one side of the rest portion and the support section, a second edge bent and connected with another side of the rest portion, two second insertion plates respectively outwardly extending from two ends of the first edge, two third insertion plates respectively outward extending from two ends of the second edge, two first fixing plates respectively bent from the third side and fourth side in the first direction and positioned between the stop wall and the wrist rest section and two second fixing plates respectively bent from two ends of the rest portion in a second direction reverse to the first direction.

The two side bars are locked on two sides of the bracket body. Each side bar has a first insertion slit formed on inner side of the side bar for the first insertion plate to insert therein, a second insertion slit formed on inner side of the side bar for the second insertion plate to insert therein and a third insertion slit formed on inner side of the side bar for the third insertion plate to insert therein. The side bars is locked on the first and second fixing plates of the bracket body.

The pair of slide rails are respectively mounted on outer sides of the side bars for guiding and slidably mounting the bracket body under the computer desk.

The pair of slide rails are respectively mounted on outer sides of the side bars for guiding and slidably mounting the bracket body under the computer desk.

Still alternatively, the bracket structure of computer desk of the present invention includes a bracket body, two side bars and a pair of slide rails. The bracket body is made of one single metal panel by integral punching and pressing. The bracket body includes: a first side; a second side opposite to the first side; a third side connecting with one end of each of the first and second sides; a fourth side connecting with the other end of each of the first and second sides; a rectangular support section defined by the first, second, third and fourth sides, the support section being a plane section for supporting an article such as a keyboard, a mouse, etc.; a stop wall upward projecting from the first side of the bracket body in a first direction normal to the support section; a wrist rest section elevated from the second side of the bracket body in the first direction opposite to the stop wall, the wrist rest section serving as a section for a user's wrist to bridge over to operate the keyboard or the mouse, the wrist rest section having a rest portion upwardly projecting from the support section, a first edge bent and connected between one side of the rest portion and the support section and a second edge bent and connected with another side of the rest portion; at least one insertion plate outward extending from each of the third and fourth sides of the bracket body; and at least one fixing plate bent from each of the third and fourth sides in the first direction.

The two side bars are locked on two sides of the bracket body. Each side bar has at least an insertion slit formed on inner side of the side bar for the insertion plate to insert therein. The side bars are locked on the fixing plate of the bracket body.

The pair of slide rails are respectively mounted on outer sides of the side bars for guiding and slidably mounting the bracket body under the computer desk.

The present invention can be best understood through the following description and accompanying drawings wherein:

DETAILED DESCRIPTION OF THE PREFERRED EMBODIMENTS

Figure 1:
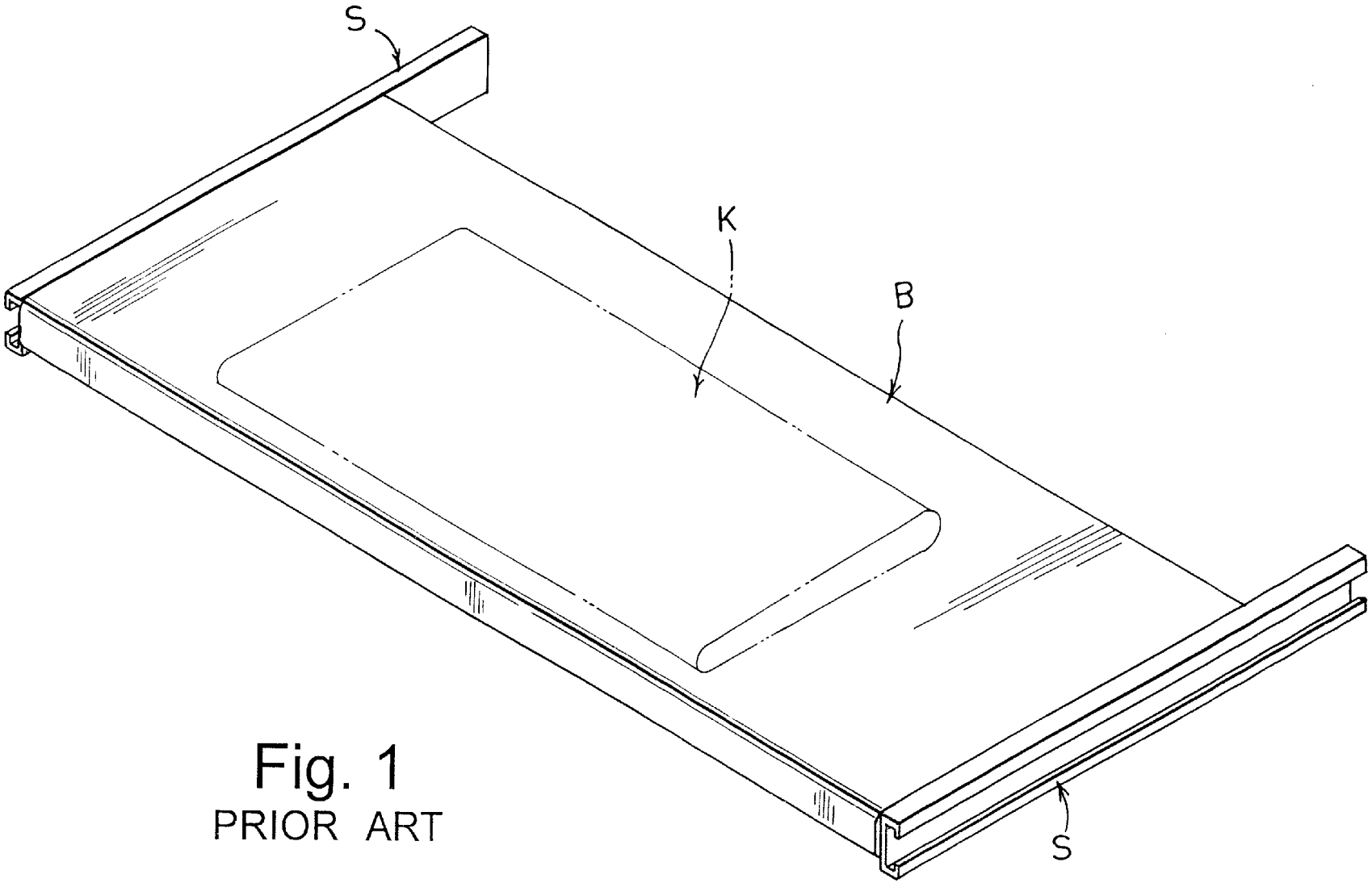
Fig. 1 PRIOR ART
FIG. 1 is perspective view of a typical bracket structure of computer desk of the prior art.
Figure 2:
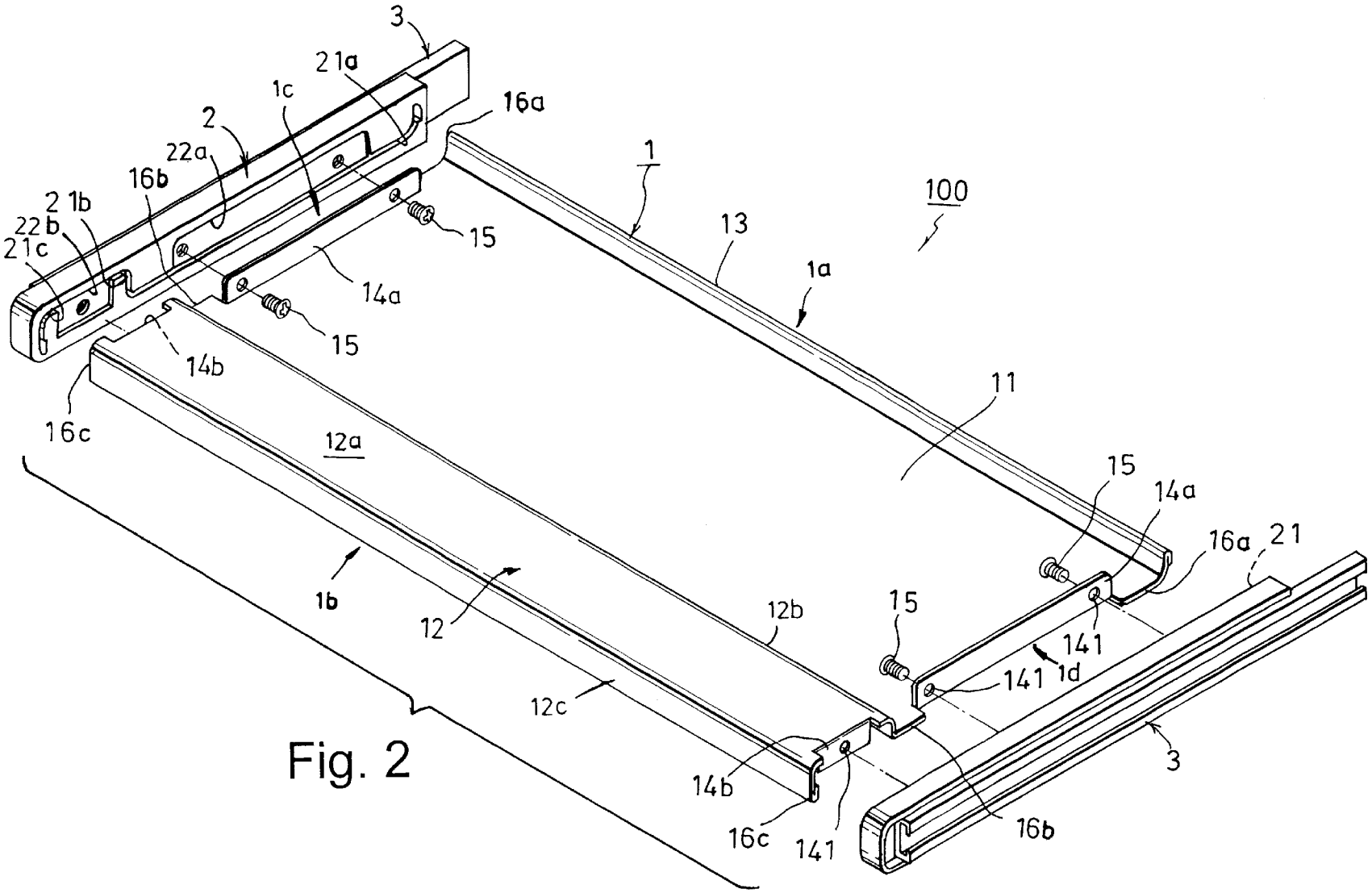
FIG. 2 is perspective exploded view of the bracket structure of computer desk of the present invention.
Figure 3:
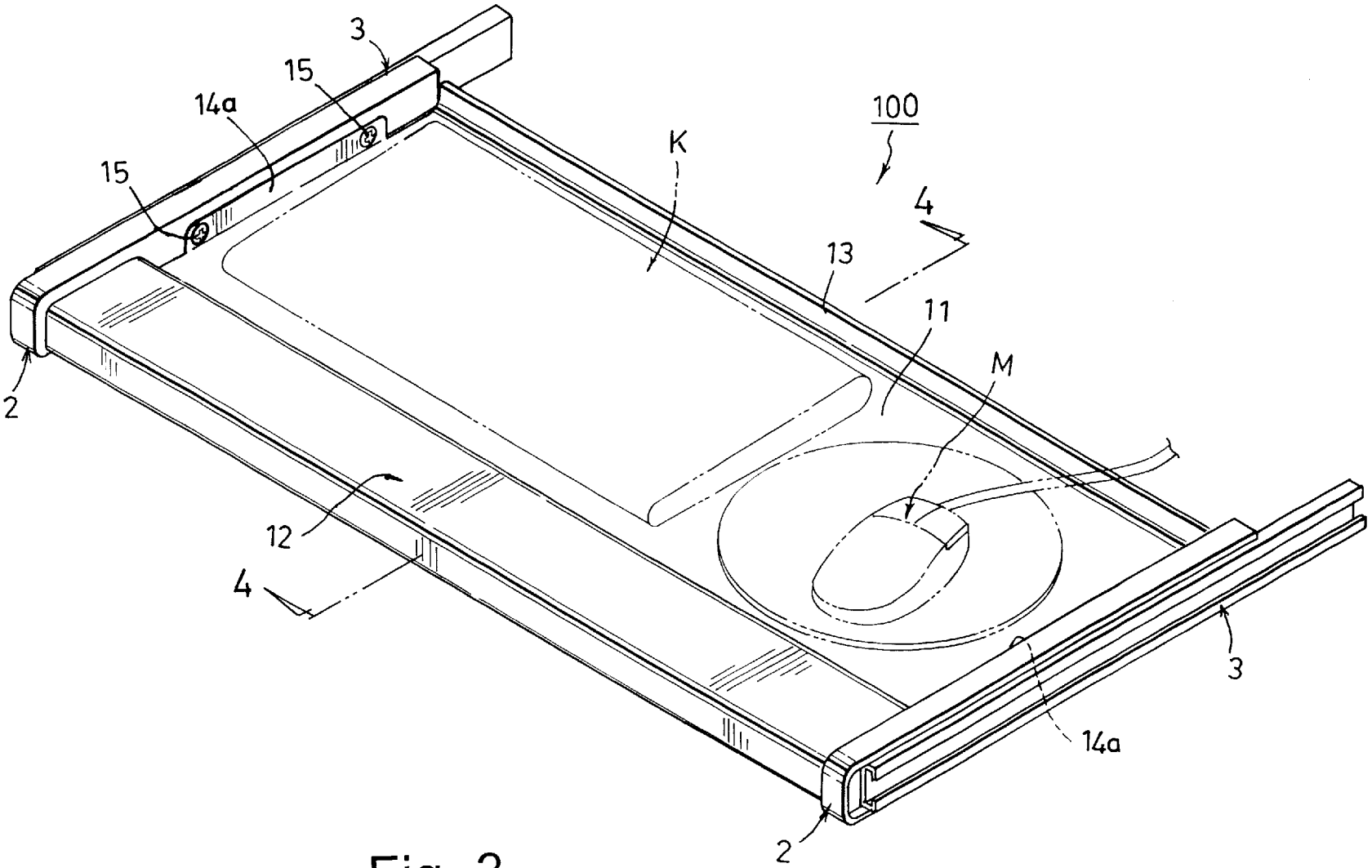
FIG. 3 is a perspective assembled view of the bracket structure of computer desk of the present invention.
Figure 4:
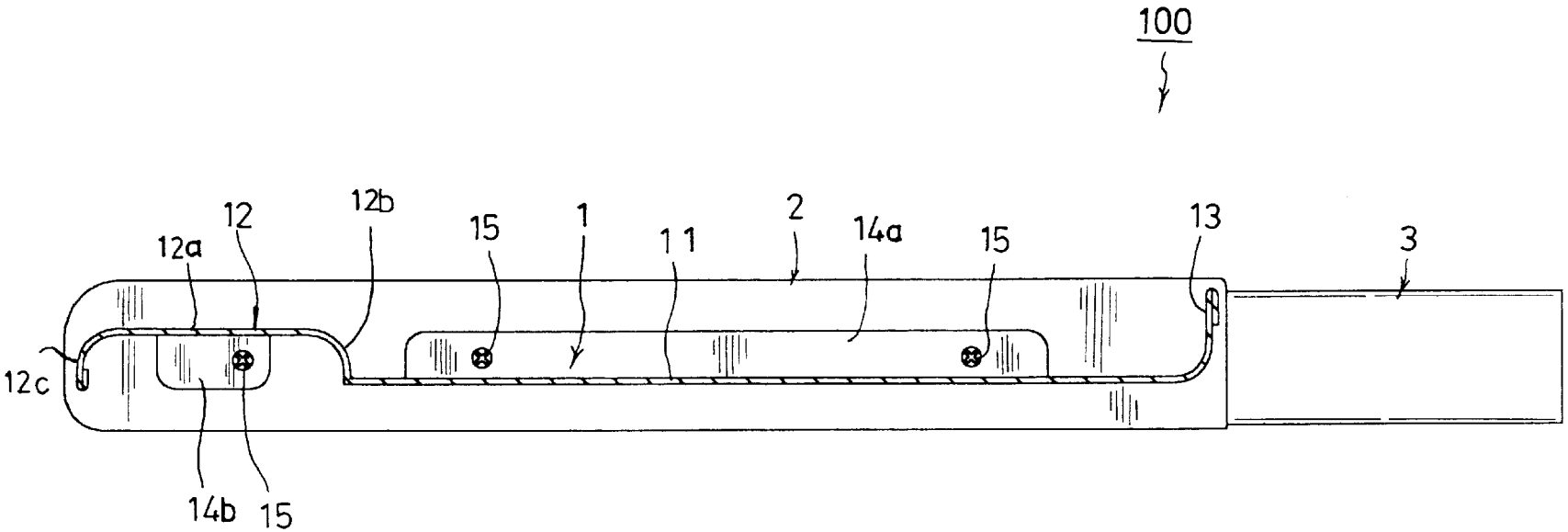
FIG. 4 is a sectional view taken along line 4—4 of FIG. 3.

Please refer to FIGS. 2, 3 and 4. The bracket structure 100 of the computer desk of the present invention includes a bracket body 1, two side bars 2 fixedly mounted on two sides of the bracket body 1 and a set of slide rails 3 fixedly mounted on outer sides of the side bars 2, enabling the bracket structure 100 to be slidably installed in a computer desk.

The bracket body 1 is made of one single metal panel by integral punching and pressing. The bracket body 1 includes a first side 1*a*, a second side 1*b* opposite to the first side 1*a*, a third side 1*c* connecting with one end of each of the first and second sides 1*a*, 1*b* and a fourth side 1*d* connecting with the other end of each of the first and second side 1*a*, 1*b*. The first, second, third and fourth sides define a plane rectangular support section 11 having sufficient width for supporting an article such as a keyboard K, a mouse M, a mouse pad, etc. The front edge of the support section of the bracket body 1 (the second side 1*b* of the bracket body 1) is formed with an elevated section to form a wrist rest section 12 for a user's wrist to bridge over the wrist rest section 12 for operating the keyboard K or the mouse M. A stop wall 13 upward projects from the rear edge of the support section (the first side 1*a* of the bracket body 1) in a first direction normal to the support section 11. The stop wall 13 serves to stop the keyboard K, etc. placed on the support section 11 from rearward sliding or dropping. Each of two ends of the stop wall 13 has an outward extending first insertion plate 16*a*.

The wrist rest section 12 is elevated from the second side 1*b* of the support section 11 in the first direction opposite to the stop wall 13. A user's wrist can be rested on the wrist rest section 12 for operating a keyboard K or a mouse M as shown in FIG. 3. The wrist rest section 12 has a rest portion 12*a*, a first edge 12*b*, a second edge 12*c*, two second insertion plates 16*b* and two third insertion plates 16*c*. The rest portion 12*a* upward projects from the support section 11. The first edge 12*b* is bent and connected between one side of the rest portion 12*a* and the support section 11. The second edge 12*c* is bent and connected with another side of the rest portion 12*a*. The second insertion plates 16*b* respectively outward extend from two ends of the first edge 12*b*. The third insertion plates 16*c* respectively outward extend from two ends of the second edge 12*c*.

The third side 1*c* and fourth side 1*d* of the bracket body 1 respectively have two first fixing plates 14*a* and two second fixing plates 14*b*. The two first fixing plates 14*a* are respectively bent from the third side 1*c* and fourth side 1*d* in the first direction. Each first fixing plate 14*a* is positioned between the stop wall 13 and the wrist rest section 12. The two second fixing plates 14*b* are respectively bent from two ends of the rest portion 12*a* in a second direction reverse to the first direction. Each of the fixing plates 14*a*, 14*b* is formed with at least one through hole 141. A screw or a rivet 15 is passed through the through hole 141 to fix the fixing plate 14*a*, 14*b* on inner side of the side bar 2.

Each side bar 2 has a first insertion slit 21*a*, a second insertion slit 21*b* and a third insertion slit 21*c* respectively formed on different portions of the side bar 2. The first insertion slit 21*a* corresponds to the first insertion plate 16*a* for the first insertion plate 16*a* to insert therein. The second insertion slit 21*b* corresponds to the second insertion plate 16*b* for the second insertion plate 16*b* to insert therein. The third insertion slit 21*c* corresponds to the third insertion plate 16*c* for the third insertion plate 16*c* to insert therein. By means of screws 15, the side bars 2 are locked on the first and second fixing plates 14*a*, 14*b* of the bracket body 1. The inner side of each side bar 2 is formed with a first and a second receptacles 22*a*, 22*b* corresponding to the first and second fixing plates 14*a*, 14*b*, in which the first and second fixing plates 14*a*, 14*b* are inlaid. The first and second fixing plates 14*a*, 14*b* are flush with the inner faces of the side bars 2 as shown in FIG. 3. The slide rails 3 mounted on outer sides of the side bars 2 are conventional slide rails applied to a conventional computer desk bracket.

The bracket body 1 is integrally made of metal panel by punching and pressing so that it is easy and quick to form the bracket body 1. According to different specifications of the computer desks, the bracket body 1 can be cut into different lengths. The wrist rest section 12 is elevated from the front edge front edge of the support section 11 of the bracket body 1 (the second side 1*b* of the bracket body 1) and the rear edge of the support section 11 (the first side 1*a* of the bracket body 1) is upward bent to form the stop wall 13 as an reinforcing section for the bracket body 1. Accordingly, when bracket body 1 supports the keyboard K, mouse M and the user's hand, the bracket body 1 is prevented from being deformed.

The fixing plates and insertion plates can be formed on any portion of the third side 1*c* and fourth side 1*d* of the bracket body 1 without specific limitation.

According to the above arrangement, the present invention has the following advantages:

1. The bracket body is integrally made of metal panel by punching and pressing. The bracket body can be easily and quickly manufactued to lower the cost.

2. The bracket body can be cut into different lengths as necessary to meet the requirement of different specifications of the computer desks.

3. The front and rear edges of the bracket body 1 are respectively integrally formed with a wrist rest section 12 and a stop wall 13. Therefore, the user need not additionally buy a wrist rest seat.

4. The bracket 1 is reinforced and prevented from being bent downward and deformed.

5. The wrist rest section and the stop wall also serve as the reinforcing structure for the bracket body.

6. The first fixing plate 14*a* and the second fixing plate 14*b* of two ends of the bracket structure 100 are respectively bent upward and downward. Therefore, the thickness of the bracket body 1 will not exceed the thickness of the wrist rest section 12. That is, the second fixing plate 14*b* is positioned at the elevated wrist rest section 12 and downward bent, while the first fixing plate 14*a* is positioned at the recessed support section 11 and upward bent. By means of respectively bending the first and second fixing plates upward and downward, the thickness of the bracket body 1 will not exceed the thickness of the wrist rest section 12. Accordingly, the bracket body 1 can be slidably connected with the slide rails without increasing the height of the slide rails.

7. By means of the first and second fixing plates 14*a*, 14*b* and the first, second and third insertion plates 16*a*, 16*b*, 16*c* of two ends of the bracket body 1, the bracket body 1 can be firmly connected with the side bars 2 to form a rigid bracket structure.

The above embodiments are only used to illustrate the present invention, not intended to limit the scope thereof. Many modifications of the above embodiments can be made without departing from the spirit of the present invention.

What is claimed is:

1. Bracket structure of computer desk, comprising:

(A) a bracket body made of one single metal panel by integral punching and pressing, the bracket body including:
- (a) a first side;
- (b) a second side opposite to the first side;
- (c) a third side connecting with one end of each of the first and second sides;
- (d) a fourth side connecting with the other end of each of the first and second sides;
- (e) a rectangular support section defined by the first, second, third and fourth sides, the support section being a plane section for supporting an article such as a keyboard, a mouse, etc.;
- (f) a stop wall upwardly projecting from the first side of the bracket body in a first direction normal to the support section, each of two ends of the stop wall having an outward extending first insertion plate; and
- (g) a wrist rest section elevated from the second side of the bracket body in the first direction opposite to the stop wall, the wrist rest section serving as a section for a user's wrist to bridge over to operate the keyboard or the mouse, the wrist rest section having a rest portion upwardly projecting from the support section, a first edge bent and connected between one side of the rest portion and the support section, a second edge bent and connected with another side of the rest portion, two second insertion plates respectively outwardly extending from two ends of the first edge, two third insertion plates respectively outwardly extending from two ends of the second edge, two first fixing plates respectively bent from the third side and fourth side in the first direction and positioned between the stop wall and the wrist rest section and two second fixing plates respectively bent from two ends of the rest portion in a second direction reverse to the first direction;

(B) two side bars locked on two sides of the bracket body, each side bar having a first insertion slit formed on inner side of the side bar for the first insertion plate to insert therein, a second insertion slit formed on inner side of the side bar for the second insertion plate to insert therein and a third insertion slit formed on inner side of the side bar for the third insertion plate to insert therein, the side bars being locked on the first and second fixing plates of the bracket body; and (C) a pair of slide rails respectively mounted on outer sides of the side bars for guiding and slidably mounting the bracket body under the computer desk.

2. Bracket structure for a computer desk, comprising:

(A) a bracket body made of one single metal panel by integral punching and pressing, the bracket body including:
- (a) a first side;
- (b) a second side opposite to the first side;
- (c) a third side connecting with one end of each of the first and second sides;
- (d) a fourth side connecting with the other end of each of the first and second sides;
- (e) a rectangular support section defined by the first, second, third and fourth sides, the support section being a plane section for supporting an article such as a keyboard, a mouse, etc.;
- (f) a stop wall upwardly projecting from the first side of the bracket body in a first direction normal to the support section;
- (g) a wrist rest section elevated from the second side of the bracket body in the first direction opposite to the stop wall, the wrist rest section serving as a section for a user's wrist to bridge over to operate the keyboard or the mouse, the wrist rest section having a rest portion upwardly projecting from the support section, a first edge bent and connected between one side of the rest portion and the support section and a second edge bent and connected with another side of the rest portion;
- (h) at least one insertion plate outwardly extending from each of the third and fourth sides of the bracket body; and
- (i) at least one fixing plate bent from each of the third and fourth sides in the first direction;

(B) two side bars locked on two sides of the bracket body, each side bar having at least an insertion slit formed on inner side of the side bar for the insertion plate to insert therein, the side bars being locked on the fixing plate of the bracket body; and (C) a pair of slide rails respectively mounted on outer sides of the side bars for guiding and slidably mounting the bracket body under the computer desk.

* * * * *